US007686601B2

(12) United States Patent
O'Brien, II

(10) Patent No.: US 7,686,601 B2
(45) **Date of Patent: *Mar. 30, 2010**

(54) HIGH PRESSURE TELESCOPING GEAR PUMPS AND MOTORS

(75) Inventor: James A. O'Brien, II, La Salle, MI (US)

(73) Assignee: Limo-Reid, Inc., Deerfield, MI (US)

( * ) Notice: Subject to any disclaimer, the term of this patent is extended or adjusted under 35 U.S.C. 154(b) by 738 days.

This patent is subject to a terminal disclaimer.

(21) Appl. No.: 11/548,465

(22) Filed: Oct. 11, 2006

(65) Prior Publication Data

US 2009/0110584 A1 Apr. 30, 2009

Related U.S. Application Data

(63) Continuation-in-part of application No. 11/101,837, filed on Apr. 8, 2005, now Pat. No. 7,179,070.

(60) Provisional application No. 60/725,555, filed on Oct. 11, 2005.

(51) Int. Cl.
*F03C 2/00* (2006.01)
*F04C 2/00* (2006.01)

(52) U.S. Cl. ..... 418/206.6; 418/19; 418/21; 418/206.1; 418/132; 418/133; 417/310

(58) Field of Classification Search ..... 418/206.6, 418/132, 133, 21, 206.7, 206.1, 1, 19; 417/310
See application file for complete search history.

(56) References Cited

U.S. PATENT DOCUMENTS

| | | | | |
|---|---|---|---|---|
| 815,522 | A * | 3/1906 | Fraser | 418/21 |
| 1,742,215 | A * | 1/1930 | Pigott | 418/21 |
| 2,098,652 | A * | 11/1937 | Buckbee | 418/133 |
| 2,463,950 | A * | 3/1949 | Carroll | 418/21 |
| 5,620,315 | A * | 4/1997 | Pfuhler | 418/21 |
| 7,179,070 | B2 * | 2/2007 | O'Brien, II | 418/132 |
| 7,281,376 | B2 * | 10/2007 | O'Brien, II | 60/493 |
| 2001/0024618 | A1 * | 9/2001 | Winmill | 418/21 |

* cited by examiner

*Primary Examiner*—Thomas E Denion
*Assistant Examiner*—Mary A Davis
(74) *Attorney, Agent, or Firm*—Fraser Clemens Martin & Miller LLC; William J. Clemens

(57) ABSTRACT

Rotary seals in a telescoping gear pump/motor a feature that allows the seal to shift radially relative to other components while maintaining the seal integrity and without compromising the function of the bearings or the bushings needed to bear the load.

1 Claim, 4 Drawing Sheets

10
3a
3b
4
3c
3
1
4

10
3b
3c
3a
3
4

HIGH PRESSURE TELESCOPING GEAR PUMPS AND MOTORS

CROSS-REFERENCE TO RELATED APPLICATION

This application is a continuation-in-part of the U.S. patent application Ser. No. 11/101,837 filed Apr. 8, 2005.

This application claims the benefit of U.S. provisional patent application Ser. No. 60/725,555 filed Oct. 11, 2005.

BACKGROUND OF THE INVENTION

The present invention relates generally to telescoping gear pumps and motors and, in particular, to a sealing apparatus for such pumps and motors.

Gear pumps and motors provide variable displacement capabilities to some of the most hostile environments. The sealing however on these functionally durable pumps with variable displacement has been an issue. The rotary seals on the gears have to be maintained by even as the internal components shift as the pressure in the pump increases. The gears shift away from the pressure causing many of the other pump/motor technologies with telescoping. The present invention provides a method of and apparatus for eliminating this shortcoming in an otherwise robust technology.

SUMMARY OF THE INVENTION

The rotary pump and motor described in U.S. Pat. No. 815,522 probably worked at the relatively low pressures needed for irrigation. The pressure required to maintain these seals in today's applications however can be extremely high; so high that the seal may fail completely as the components inside the pump/motor begin to distort even slightly under the operating pressure. The rotary seals of the pump/motor according to the present invention have a feature added to them that allows the seal so shift with the other components while maintaining the seal integrity and without compromising the function of the bearings or the bushings needed to bear the load.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

U.S. patent application Ser. No. 11/101,837, filed Apr. 8, 2005, is hereby incorporated by reference. U.S. provisional patent application Ser. No. 60/725,555, filed Oct. 11, 2005, is hereby incorporated herein by reference.

Figure 1:
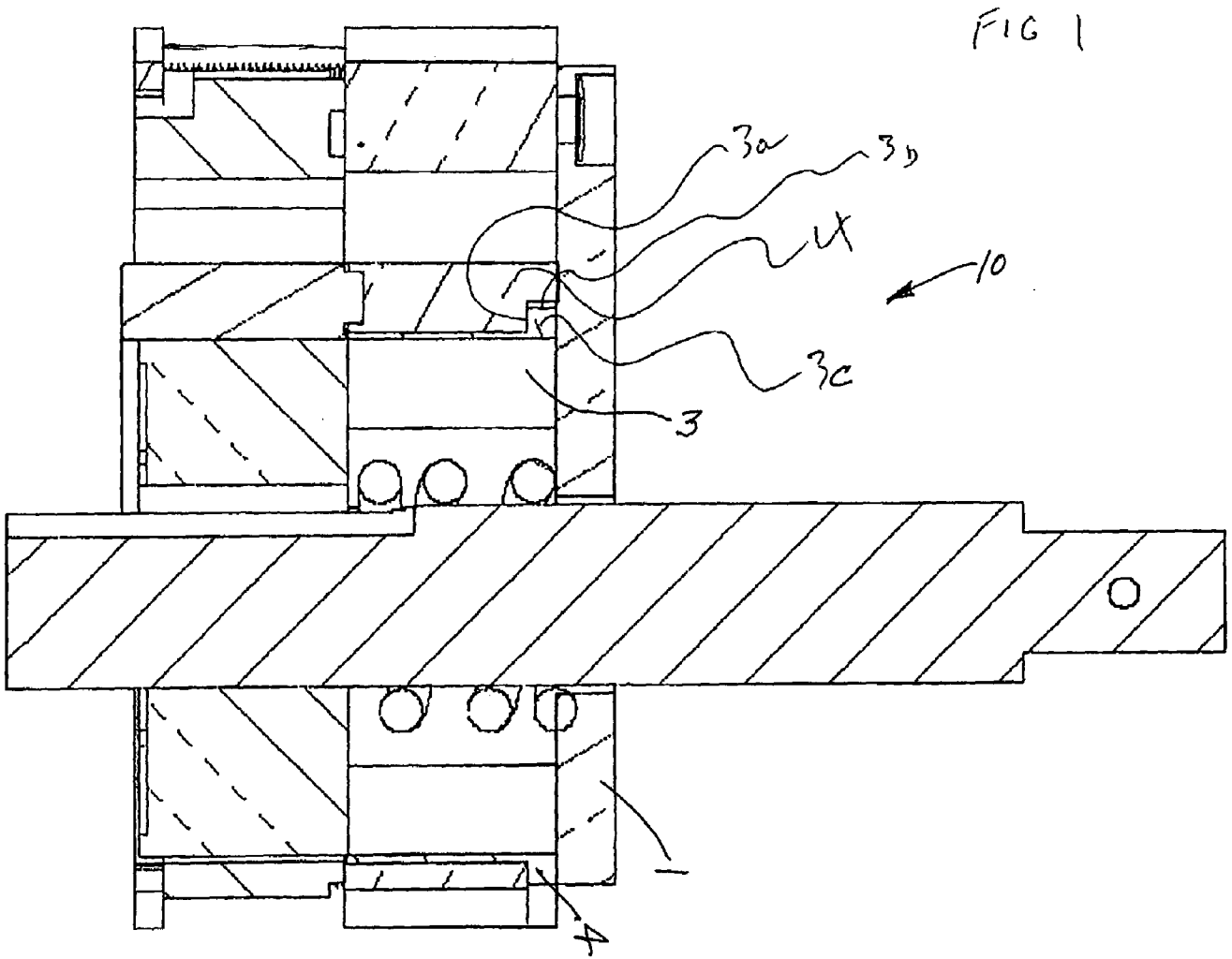
FIG. 1 is a cross section of an internal gear pump/motor according to the present invention.
Figure 2:
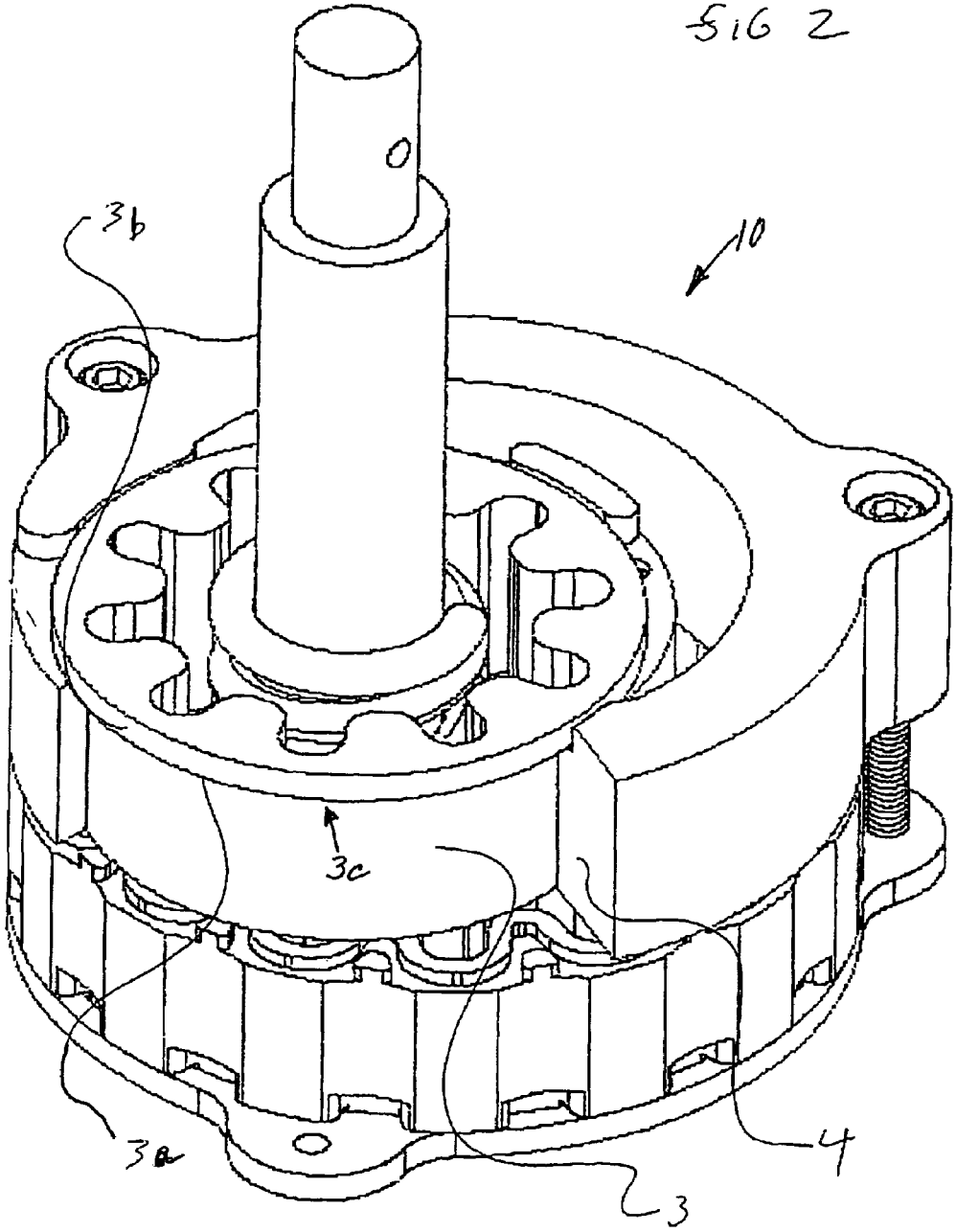
FIG. 2 is a perspective view of the internal gear pump/motor shown in FIG. 1 with portions in cutaway.
Figure 3:
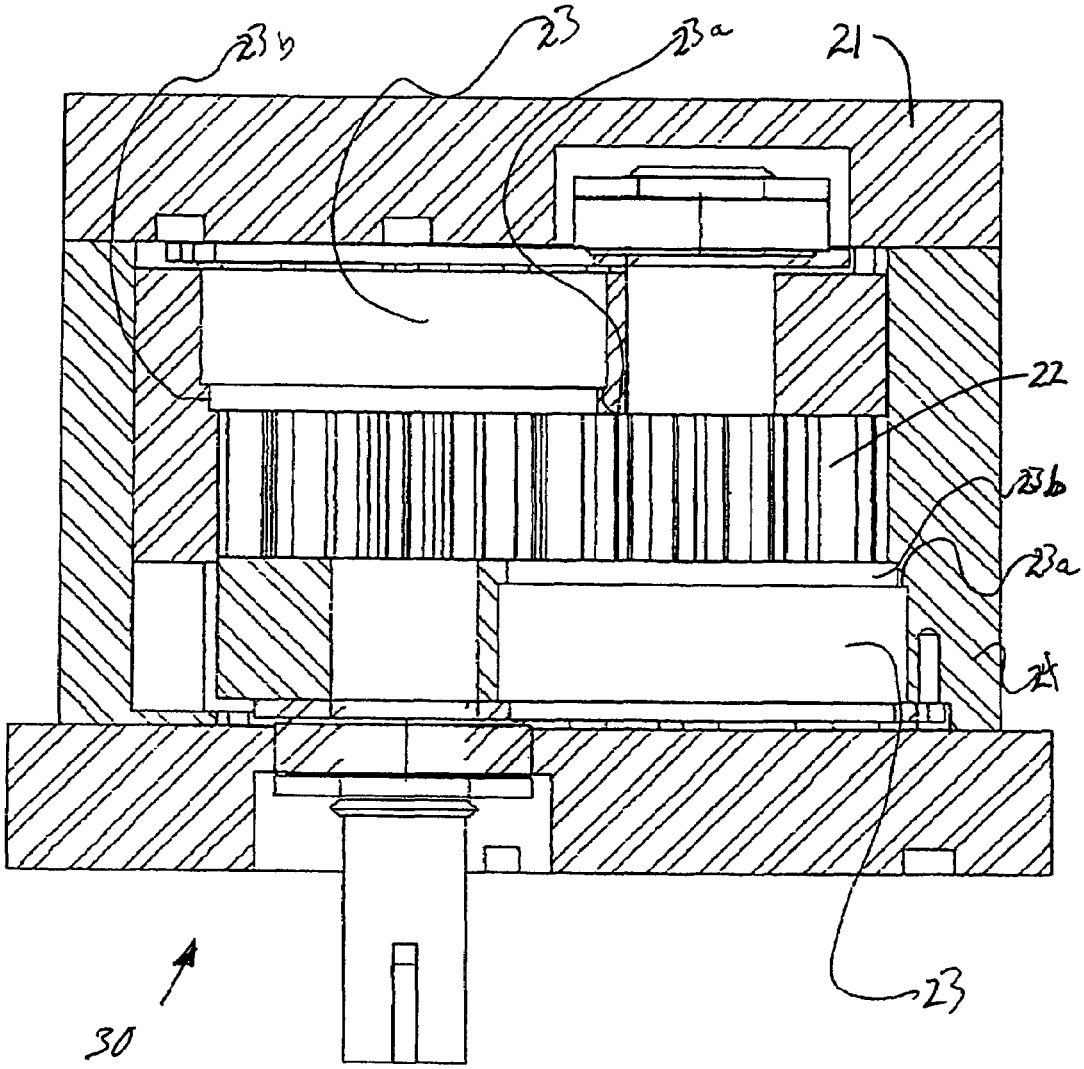
FIG. 3 is a cross section of an external gear pump/motor according to the present invention.
Figure 4:
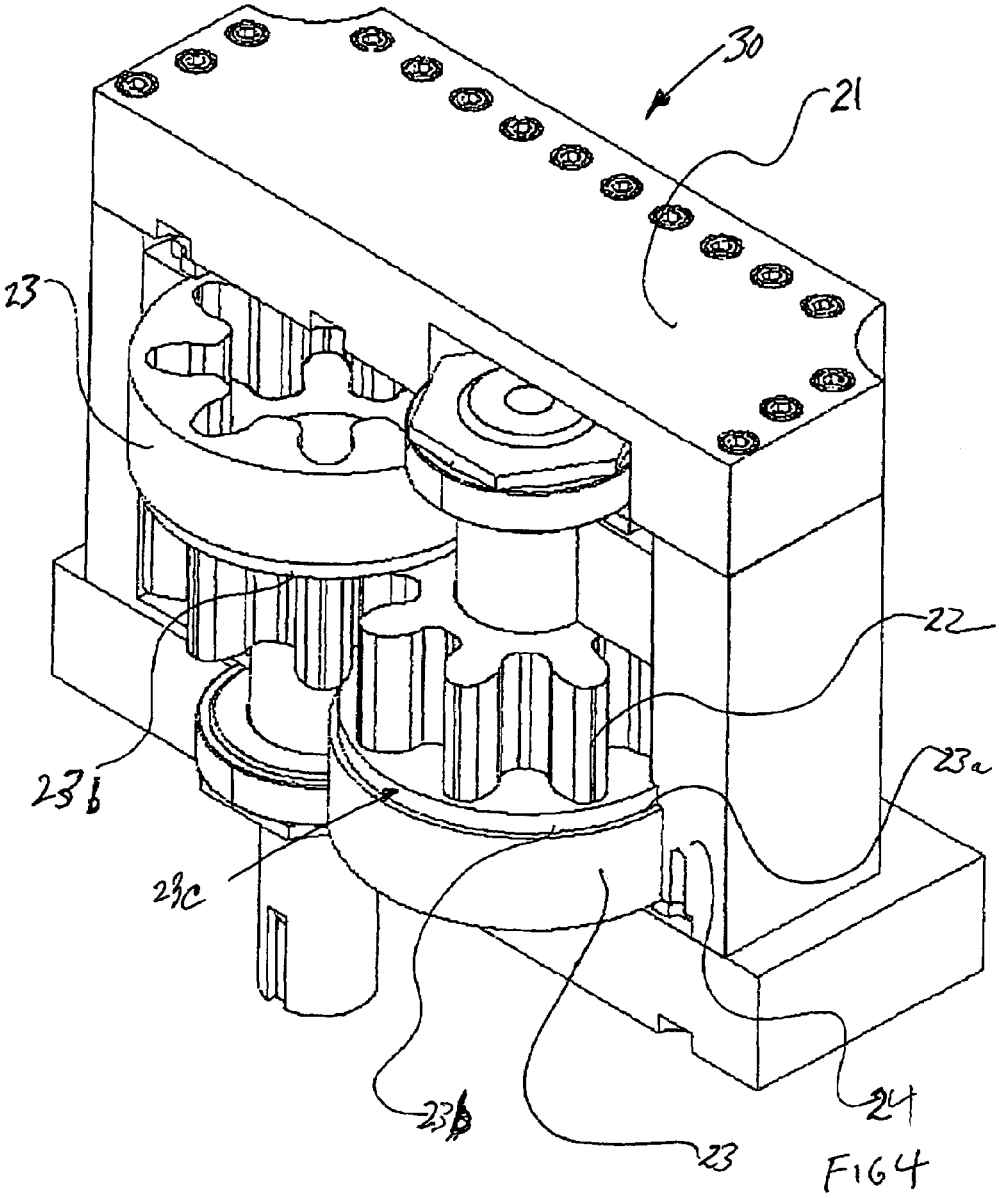
FIG. 4 is a perspective view of the external gear pump/motor shown in FIG. 3 with portions in cutaway.

In the drawings, the components of the external gear pump/motor shown in FIGS. 3 and 4 are identified with reference numerals that are twenty numbers higher than the reference numerals for similar components of the internal gear pump/motor shown in FIGS. 1 and 2.

The internal gear pump/motor 10 shown in FIGS. 1 and 2 includes a hollow seal housing 4 closed at one end by a cap 1. A tubular rotary seal 3 has a radially outwardly extending flange 3*c* including a downwardly facing annular pressure shift surface 3*a* and an outwardly facing peripheral shift riser 3*b*.

In order to maintain a seal as the pressure develops in the pump/motor 10, the seal 3 will shift away from the applied fluid pressure toward the low pressure side of the pump/motor. At low pressures this shifting in minimal and prior art telescoping gear pumps/motors can maintain the seals by simply controlling the tolerance at the interface points between the moving parts. However, as the pressure increases the materials of the pump/motor begin to distort. The pressure distortion forms a gap that runs the length of the seal causing the pump/motor to leak internally.

The shift surface 3*a* nests into a matching feature in the seal housing 4 so that the amount of radial distortion that can be tolerated before a leak can begin is the width of the shift surface 3*a*.

The external gear pump/motor 30 shown in FIGS. 3 and 4 includes a hollow seal housing 24 closed at one end by a cap 21. A pair of gears 22 having pluralities of meshing teeth are disposed in the hollow teal housing 24. The hollow seal housing 24 further includes a first port (not shown) and a second port (not shown) that extend between an internal surface and an external surface thereof. One of the ports is connected to a low pressure segment of fluid system (not shown) such as a reservoir or the like, and another of the ports is connected to a high pressure or pressurized segment of the fluid system.

In operation, a shaft of the external gear pump/motor 30 is connected to a prime mover (not shown), such as an electric motor or the like. When the prime mover rotates the shaft, one of the gears 22 rotates and causes the other of the gears 22 to rotate. Fluid is introduced from the fluid system through one of the ports, is trapped between the pluralities of meshing teeth of the gears 22, and is discharged through the other of the ports. Suitable passages are formed in the hollow seal housing 24 to ensure that the fluid is routed correctly during operation of the external gear pump/motor 30. Each of the two tubular rotary seals 23 provides a rotating seal between each of the gears 22 and inner surfaces of the hollow seal housing 24 to ensure the integrity of the cavity of the external gear pump/motor 30. The external gear pump/motor 30 in accordance with the present invention requires only the tubular rotary seals 23 to maintain a seal and allow for efficient operation of the extending gear pump/motor 30. Each of two tubular rotary seals 23 has a radially inwardly extending step 23*c* including an annular pressure shift surface 23*a* and an outwardly facing peripheral shift riser 23*b*. The steps 23*c* face one another and cooperate to permit radial distortion before a leak can begin.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A telescoping gear pump, comprising:

a hollow seal housing having a cavity formed therein, at least one inlet port for fluid into said cavity and at least one outlet port fluid out of said cavity;

a first gear disposed in said cavity and having a plurality of teeth;

a second gear disposed in cavity and having a plurality of teeth meshing with said teeth of said first gear; a shaft rotatably mounted to said housing, said second gear being attached to said shaft for co-rotation and said first gear being axially moveable along said shaft relative to said second gear for varying a displacement of said cavity;

a tubular rotary first seal rotatably disposed in said cavity and having a plurality of teeth engaging said teeth of said first gear; and a tubular rotary second seal disposed in said cavity and having a plurality of teeth engaging said teeth of said second gear whereby when pressured liquid is supplied to said at least one inlet port, the pressured fluid rotates said first and second gears causing said shaft to rotate for operation as a motor, and when said shaft is rotated, said second gear rotates said first gear for operation as a pump causing fluid to flow from said at least one inlet port to said at least one outlet port and wherein said first gear and said second seal are free to move along an axis of said shaft in said cavity in response to internal pressure in said housing, wherein the tubular rotary first seal and the tubular rotary second seal have cooperating steps to accommodate a predetermined radial distortion without fluid leakage, the cooperating step of the tubular rotary first seal engaging the first gear and the cooperating step of the tubular rotary second seal engaging the second gear, the telescoping gear pump thereby maintaining a seal of the first and second gear in a pressure loaded condition.

* * * * *